US006561707B2

(12) United States Patent
Garramone et al.

(10) Patent No.: US 6,561,707 B2
(45) Date of Patent: May 13, 2003

(54) NEEDLE PRINTING HEAD

(75) Inventors: Andrea Garramone, Turin (IT); Ettore Quattrini, Binasco (IT); Roberto Boggio, San Giorgio Canavese (IT)

(73) Assignee: Compuprint SpA, Turin (IT)

( * ) Notice: Subject to any disclaimer, the term of this patent is extended or adjusted under 35 U.S.C. 154(b) by 0 days.

(21) Appl. No.: 09/867,848

(22) Filed: May 30, 2001

(65) Prior Publication Data

US 2001/0048835 A1 Dec. 6, 2001

(30) Foreign Application Priority Data

May 30, 2000 (IT) ..... UD00A0110

(51) Int. Cl.[7] ..... B41J 2/25

(52) U.S. Cl. ..... 400/124.1; 101/93.04; 101/93.05

(58) Field of Search ..... 101/93.04, 93.05; 400/124.1

(56) References Cited

U.S. PATENT DOCUMENTS 4,396,304 A 8/1983 Davenport et al.
4,561,790 A 12/1985 Evans et al.
4,674,896 A 6/1987 Yasunaga et al.
5,209,585 A 5/1993 Yamamoto et al.

FOREIGN PATENT DOCUMENTS

EP 0 364 800 A1 9/1989
EP 0 442 294 A2 1/1991
JP 11-320929 A 11/1999

*Primary Examiner*—Andrew H. Hirshfeld
*Assistant Examiner*—Jill E Culler
(74) *Attorney, Agent, or Firm*—Akin, Gump, Strauss, Hauer & Feld, L.L.P.

(57) ABSTRACT

A needle printing head comprising a support (11) able to axially guide a plurality of printing needles (15), each of which has one end attached to a mobile armature (16) of a corresponding actuation electromagnet (17) having a ferromagnetic core (18) provided with polar extensions. A separation element (30) is interposed between the mobile armatures (16) and the corresponding polar extensions. The separation element (30) is made of a metal material and comprises elements (33, 34) able to reduce the effects of the eddy currents which are generated by the energizing of every electromagnet (17).

12 Claims, 1 Drawing Sheet

NEEDLE PRINTING HEAD

FIELD OF THE INVENTION

The invention concerns a needle printing head comprising a plurality of electromagnetic actuators arranged in a circular crown, each one associated with a printing needle able to move axially to transfer, by impact, a particular quantity of ink from an inking element to a print support, such as a sheet of paper, a print-out or suchlike. The printing head is able to move serially along the line of writing to compose, in successive dots, any character or number, graphic symbol, code or image, either in black and white or in color, according to information arriving from a computerized control unit.

BACKGROUND OF THE INVENTION

The state of the art includes impact printers which, as a printing device, use a head comprising a plurality of needles with one end able to cooperate with an inking element, normally consisting of a ribbon, and the other end connected to the mobile armature of an electromagnetic actuator.

By selectively energizing the individual electromagnets, the needles are displaced axially so that, by means of the inking element, they impress a programmed combination of dots onto the print support according to a pre-defined matrix; the print support can consist of a sheet or printout, made of paper, plastic material or other suitable material.

A printing head with needles is described in the European patent application EP-A-0.622.213.

The printing speed which can be obtained with a needle head is very high, in the range of 1,000–1,500 characters per second (cps), when sketch mode in used, and 200 cps when high definition/high quality writing mode is used; the speed is strictly connected to the actuation cycle of each electromagnet and more particularly to the movement of the mobile armature. The frequency of energizing of the electromagnets is in the range of 3000–3600 Hz.

With frequencies like this, one of the biggest problems in designing printing heads with needles is the reduction of the eddy currents (or Foucault currents) which are generated every time at least one of the coils of the electromagnets is energized.

Maxwell's equation, which describes the distribution of the electromagnetic field, is as follows:

$$\text{rot } J=-1/\rho dB/dt$$

given that:

J=current density

B=magnetic induction

ρ=resistivity that is, a relationship is established between a phenomenon of magnetic induction, which can vary in time, and the density of a current circulating in a conductor means.

The losses due to the Joule effect can be described by the following equation:

$$P_J=\int_V \rho J^2 dV$$

On the contrary the losses due to eddy currents are proportional, in a first approximation, to the second power of the peak induction B, the second power of the thickness of the material affected d, the second power of the functioning frequency f. In the state of the art, the following expression is empirically adopted:

$$Pw=K*f^2*B^2*d^2$$

The coefficient K is specific to the material.

To reduce losses due to eddy currents, when there are variable magnetic fields, high resistivity materials (Fe—Si etc.) are used, laminated materials, sintered materials (ferrites etc.) in the magnetic circuits or, where a magnetic material is not required, insulating material is used.

In the case of printing heads with needles, the separation element is located in the ferromagnetic gap of the main magnetic circuit, therefore the variation in the induction of the magnetic field is at the maximum value and, as a consequence, also the eddy currents are very high.

It is well-known that, to prevent the eddy currents from interacting with the armatures of the command electromagnets, a sheet of insulating plastic material, such as Mylar, Kapton or similar, with a thickness of some hundredths of a millimetre, is inserted as a separation element between the polar expansions and the mobile armatures.

This sheet of plastic material, which is easily subject to wear, especially in the points at which the mobile armatures pivot on the corresponding fixed polar expansions of the electromagnets, considerably reduces the duration, that is the life, of the printing head.

Moreover, another disadvantage of conventional printing heads, which use the sheet of plastic material, is that the frequency of energizing the electromagnets must necessarily be limited, to prevent the head from overheating too much and from reaching temperatures of around 100° C., which could at least deform, if not melt, the sheet of plastic material.

From the EP-A-0.364.800 it is known a needle printing head wherein a multilayer element is interposed between the permanent magnet poles of the electromagnets and the armatures thereof. Such multilayer element comprises two thin sheets of magnetic steel between which a thin film of resilient material, such as polyester, is interposed. The sole scope of this multilayer element is to absorb the damping action of the armatures.

From the JP-A-11-320929 it is known a wire dot printer head wherein a film made of non-magnetic material is disposed between the movable armatures and the static electromagnetic core. In this embodiment the film of non-magnetic material is used firstly to prevent the abrasion of the fulcrum section of the movable armatures and secondly to reduce an influence caused by the residual magnetism generated between the core and the armature.

U.S. Pat. No. 4,396,304 discloses a wire printing apparatus wherein a non-magnetic member is provided, the member having a projecting ear corresponding to each coil position within a printing head, each ear being interposed between the ends of the yoke assemblies and the associated armature to provide a conventional residual non-magnetic gap spacer against which the armature bears in the closed position.

From the U.S. Pat. No. 4,561,790 it is known a wire matrix print head apparatus wherein a residual magnetism interrupter constituted by a thin non-magnetic or dielectric plastic material is disposed to separate the armatures from direct physical contact with the central electromagnetic cores of the actuation windings. Such residual magnetism interrupter has only the scope to prevent slight magnetism in the armatures from retarding the return thereof.

From the U.S. Pat. No. 5,209,585 it is known a print head for a dot matrix printer wherein a residual sheet, made of non-magnetic material, such as ferroalloy, is attached to the electromagnetic core. Such residual sheet has a minimum thickness necessary for preventing the plunger of the armatures from sticking to the core and for preventing the end portion of the armature from floating from the yoke even if the armature is deflected when the latter strikes a center ring of non-magnetic material.

None at all of the above-mentioned documents shows or suggests a needle or wire printing head provided with means able to prevent that the eddy currents have a negative influence on the actuation elements of the printing needles.

SUMMARY OF THE INVENTION

The invention is set forth and characterized in the main claim, while the secondary claims describe other innovative characteristics of the invention.

The main purpose of the invention is to achieve a printing head with needles which has a high energy yield, wherein the eddy currents do not have a negative influence on the actuation elements of the printing needles.

At the same time the printing head according to the invention must be able to improve performance in terms of functioning frequency, number of copies which can be printed and overall quantity of characters printed during its life, compared with printing heads which are on the market today, that is to say, more than 400–700 million characters or numbers.

In accordance with said purposes, the printing head according to the invention comprises a thin foil of metal material, suitably shaped, interposed between the mobile armatures and the polar expansions of the actuation electromagnets.

A generic metal separation element, however, without adequate means able to prevent the propagation of the eddy currents, would provide a performance inferior to the equivalent non-conductor and therefore would be practically unusable (high eddy currents downgrade the performance in terms of functioning frequency and repeatability of positioning of the print dots).

The technique used to drastically reduce the eddy currents consists of achieving a geometric conformation of the metal foil able to reduce the area affected by the eddy currents, that is, to increase the resistivity of the electric circuit affected by them. According to a preferential embodiment, a plurality of notches is made on the metal foil, in correspondence with the polar expansions of the actuation electromagnets.

The invention is able to guarantee, with regard to the physical and functioning aspects of the printing head, at least the following advantages:

a) an adequate ferromagnetic gap between the polar expansions of the electromagnets is provided;

b) the impact between the mobile armatures and the fixed ferromagnetic cores of the electromagnets is absorbed;

c) a reliable, wear-resistant and long-lasting fulcrum point is provided;

d) the eddy currents generated by the variation in the magnetic field are drastically reduced; and e) it functions even at high temperatures (more than 100° C.).

Using a metal separation element, with techniques to reduce the eddy currents, allows to improve the following features:

Energy yield (eddy currents have no function with regard to the printing);

Performance in terms of pages printed per hour (reduction in the heat generated by the eddy currents and therefore the device has a lower temperature);

Frequency performance (eddy currents introduce a delay in the movement of the armature).

An increase in the average life of the printing head, compared with those using a sheet of plastic material, is obtained because the metal material used as a separation element suffers practically no wear over time at the fulcrum point, so that the working life of the printing head in its entirety is no longer a function of the life of the material used as a separation element, which was the weak link in the chain.

BRIEF DESCRIPTION OF THE DRAWINGS

These and other characteristics of the invention will become clear from the following description of a preferred form of embodiment given as a non-restrictive example with reference to the attached drawings wherein.

DETAILED DESCRIPTION OF PREFERRED EMBODIMENT

Figure 1:
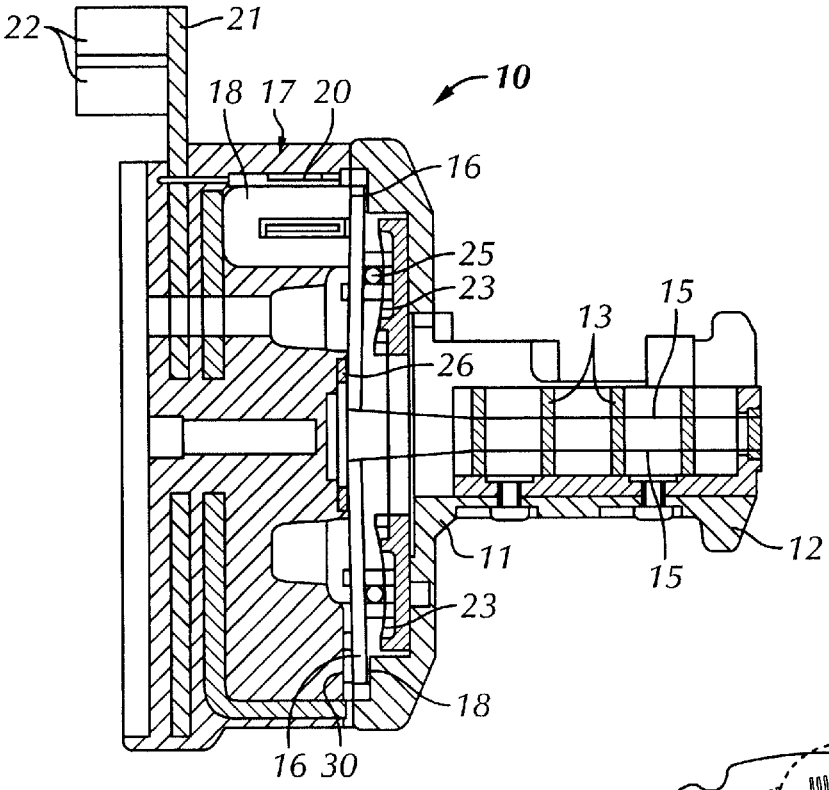
FIG. 1 is a longitudinal section of a printing head with needles according to the invention.

With reference to FIG. 1, a printing head 10 according to the invention comprises a metal support 11 with a front part 12 provided with transverse guides 13 able to guide a plurality of printing needles 15. Normally there are at least 7 needles and their outer ends are aligned with each other. In the example shown here, there are 24 printing needles.

Each needle 15 is made of very wear-resistant material, such as for example tungsten, and has a diameter of between 0.2 and 0.4 mm.

The inner end of each of the 24 needles 15 is welded to a corresponding mobile armature 16 of an electromagnet 17 which comprises a U-shaped ferromagnetic core 18, with the polar expansions substantially on the same plane. Around the outer column of each ferromagnetic core 18 an excitation coil 20 is wound.

Figure 2:
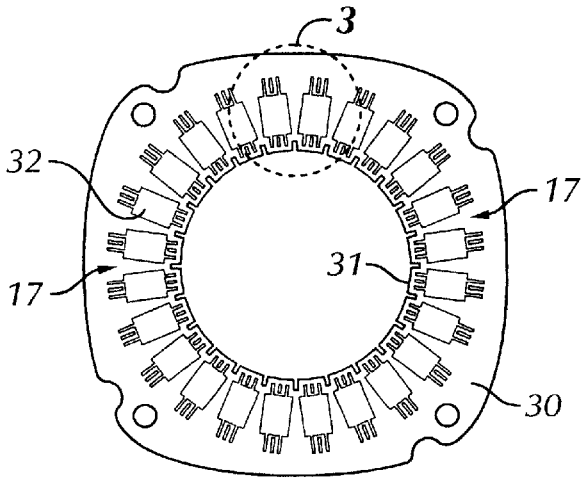
FIG. 2 is a front view of an element of the printing head shown in FIG. 1.

The 24 electromagnets 17 are arranged spoke-like (FIG. 2), each one at an equal angular distance from the other.

The coils 20 are connected to a printed circuit 21 mounted on the rear part of the head 10 and provided with connectors 22 by means of which the printed circuit 21 is able to be connected to a computerized control unit, of a conventional type and not shown in the drawings.

An elastic system comprising foil springs 23 arranged radially and an O-ring 25 is able to normally maintain the needles 15 in a retracted, inactive position, with the armatures 16 resting on an annular stop element 26.

Figure 3:
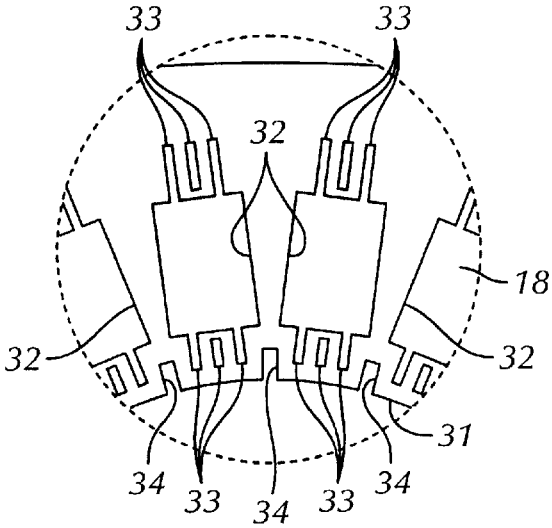
FIG. 3 is an enlarged detail of the element shown in FIG. 2.

According to a characteristic feature of the invention, between the polar expansions of the electromagnets 17 and the mobile armatures 16, a metal separation element 30 is interposed (FIGS. 2 and 3), for example made of amagnetic steel, with a thickness of between 0.01 and 0.04 mm, advantageously between 0.02 and 0.03 mm.

The separation element 30, which is made for example by molding, comprises a central hole 31 and a plurality of radial apertures 32, each of which has a substantially rectangular section and able to be arranged in correspondence with the polar expansions of the ferromagnetic cores 18.

The separation element 30 also comprises means able to prevent the eddy currents, which are generated with every excitation of a coil 20, from propagating and from having a negative influence on the actuation cycle of the mobile armatures 16. These means comprise a plurality of radial notches 33, which are associated with each radial aperture 32.

In the example shown here, there are six radial notches 33 for each aperture 32, three for each smaller side of the latter, that is to say, a first group of three towards the central hole 32 and a second group of three towards the outer edge of the separation element 30. Moreover, while the two most lateral notches 33 of each group are contiguous with the aperture 32, so as to form radial extensions thereof, the central one is isolated and alone.

Other radial notches 34 are associated with the central hole 31 and are arranged between the most lateral radial notches 33 of each first group. The radial notches 34 are contiguous with the central hole 31, so as to form radial extensions thereof.

In this way the notches 33 and 34 reduce the surface of the separation element 30 affected by the eddy currents.

The printing head 10 as described heretofore functions as follows.

When an adequate impulse of electric tension is applied to a coil 20, a magnetic field is generated which attracts the corresponding mobile armature 16 against the polar expansions of the ferromagnetic core 18.

The corresponding needle 15 is axially displaced and made to impact in a conventional manner against an inked ribbon, which is not shown here, which in turn transfers a dot of ink onto the means which is to be printed.

It is obvious that modifications and additions can be made to the printing head 10 as described heretofore, but these shall remain within the field and scope of this invention. For example, in the separation element 30, instead of the notches 33, elements of insulating material may be inserted able to increase the resistivity of the electric current affected by the eddy currents.

It is also obvious that, although the description refers to a specific example, a person of skill shall certainly be able to achieve many equivalent forms, all of which shall come within the field and scope of the invention.

What is claimed is:

1. Printing head with needles comprising a support (11) able to axially guide a plurality of printing needles (15), each of which has one end attached to a mobile armature (16) of a corresponding actuation electromagnet (17) having a ferromagnetic core (18) provided with polar expansions, a separation element (30) being interposed between the mobile armatures (16) and the corresponding polar expansions, the printing head being characterized in that said separation element (30) is made of a metal material and comprises means (33, 34) able to reduce the effect of the eddy currents which are generated by the energizing of every electromagnet (17).

2. Printing head as in claim 1, characterized in that said metal material is amagnetic.

3. Printing head as in claim 1, characterized in that said separation element (30) comprises a steel sheet with a thickness in the order of several hundredths of a millimetre.

4. Printing head as in claim 3, characterized in that the thickness of said separation element (30) is between 0.01 and 0.04 mm.

5. Printing head as in claim 3, characterized in that the thickness of said separation element is between 0.02 and 0.03 mm.

6. Printing head as in claim 1, characterized in that said means to reduce the eddy currents comprise a plurality of notches (33) made on said separation element (30) in correspondence with the polar expansions of the actuation electromagnets (17).

7. Printing head as in claim 1, characterized in that said separation element (30) comprises a plurality of apertures (32) each one associated with the polar expansions of an electromagnet (17) and that said means to reduce the eddy currents comprise notches (33) associated with each of said apertures (32).

8. Printing head with needles comprising a support (11) able to axially guide a plurality of printing needles (15), each of which has one end attached to a mobile armature (16) of a corresponding actuation electromagnet (17) having a ferromagnetic core (18) provided with polar expansions, a separation element (30) being interposed between the mobile armatures (16) and the corresponding polar expansions, the printing head being characterized in that said separation element (30) is made of a metal material and comprises means (33, 34) able to reduce the effect of eddy currents which are generated by energizing of every electromagnet (17), the separation element (30) comprising a plurality of apertures (32) each one associated with the polar expansions of an electromagnet (17) and said means to reduce the eddy currents comprising notches (33) associated with each of said apertures (32), wherein the electromagnets (17) of said printing needles (15) are arranged spoke-like, said printing head being further characterized in that said separation element (30) further comprises a central hole (31), that said apertures (32) are positioned radially with respect to said central hole (31) and that a first group of said notches (33) is arranged radially between said apertures (32) and said central hole (31).

9. Printing head as in claim 8, characterized in that a second group of said notches (33) is arranged radially between said apertures (32) and the outer edge of said separation element (30).

10. Printing head as in claim 9, characterized in that there are six of said notches (33) for each of said apertures (32), three for each of said groups, and that the two most lateral notches (33) of each group are contiguous with the corresponding aperture (32), so as to form radial extensions thereof, the central notch being alone and isolated.

11. Printing head as in claim 8, characterized in that other radial notches (34) are associated with said central hole (31) and are arranged between the most lateral radial notches (33) of each first group.

12. Printing head as in claim 11, characterized in that said other radial notches (34) are contiguous with said central hole (31), so as to form radial extensions thereof.

* * * * *